US009901226B2

(12) United States Patent
Boyd

(10) Patent No.: US 9,901,226 B2
(45) Date of Patent: Feb. 27, 2018

(54) ADJUSTABLE DEVICE TO AID IN HUMAN FECAL MATTER EVACUATION

(71) Applicant: James Boyd, San Antonio, TX (US)

(72) Inventor: James Boyd, San Antonio, TX (US)

( * ) Notice: Subject to any disclaimer, the term of this patent is extended or adjusted under 35 U.S.C. 154(b) by 0 days.

(21) Appl. No.: 15/209,414

(22) Filed: Jul. 13, 2016

(65) Prior Publication Data

US 2017/0014010 A1 Jan. 19, 2017

Related U.S. Application Data

(60) Provisional application No. 62/191,588, filed on Jul. 13, 2015.

(51) Int. Cl.
*E03D 11/00* (2006.01)
*A47K 17/02* (2006.01)

(52) U.S. Cl.
CPC ..... *A47K 17/028* (2013.01); *E03D 11/00* (2013.01)

(58) Field of Classification Search
CPC ..... A47K 17/026
USPC ..... 4/254
See application file for complete search history.

(56) References Cited

U.S. PATENT DOCUMENTS 1,067,767 A * 7/1913 Simonson ..... A47K 17/028 297/423.41
1,837,064 A * 12/1931 Ostergard ..... B60N 3/063 248/592
2,083,605 A * 6/1937 Jertberg ..... A47K 17/028 297/423.45
2,415,266 A * 2/1947 Temple ..... A47B 3/0915 4/254
3,773,320 A * 11/1973 Samiran ..... A63B 25/08 267/177
5,809,583 A * 9/1998 Pucciani ..... A47K 17/028 4/254
6,148,448 A * 11/2000 Urso ..... A47K 17/026 297/423.44
6,681,410 B1 * 1/2004 Husain ..... A47K 17/028 297/423.39
D493,497 S * 7/2004 Arginsky ..... A47K 17/028 D21/413
9,301,619 B2 * 4/2016 Verdier ..... A63B 25/08
2002/0193210 A1 * 12/2002 Turner ..... A63B 21/4047 482/80
2004/0214691 A1 * 10/2004 Gottlieb-Myers ..... A63B 25/08 482/15
2007/0042875 A1 * 2/2007 Arginsky ..... A63B 25/08 482/77
2012/0246813 A1 * 10/2012 Manning ..... A47K 17/026 4/254
2013/0210587 A1 * 8/2013 Shank ..... A63B 25/08 482/77
2015/0305509 A1 * 10/2015 Verdier ..... A47C 9/002 297/174 R (Continued)

*Primary Examiner* — Lori Baker
(74) *Attorney, Agent, or Firm* — Daniel A. Rogers; Rosenthal Pauerstein Sandoloski Agather LLP

(57) ABSTRACT

A device for allowing the puborectalis muscle to relax for easier fecal matter evacuation. The device differs from current units because it is a lightweight, portable unit that can collapse and be hidden away from view. The device has a nonslip foot rest that is adjustable based on differences in height of users. An unlocking mechanism enables a user to unlock the foot rests and fold them for easy storage.

3 Claims, 4 Drawing Sheets

(56) References Cited

U.S. PATENT DOCUMENTS

2016/0001133 A1* 1/2016 Flores ..... A63B 25/08
482/77

* cited by examiner

ADJUSTABLE DEVICE TO AID IN HUMAN FECAL MATTER EVACUATION

CLAIM OF PRIORITY TO PRIOR APPLICATION

This application claims the filing date of U.S. Provisional Patent Application Ser. No. 62/191,588, filed on Jul. 13, 2015, entitled "Adjustable Pole With Foot Rests to Aid in Human Fecal Matter Evacuation From the Rectum", the entire disclosure of which is hereby incorporated in its entirety and by reference into the present disclosure

BACKGROUND OF THE INVENTION

Many studies have been published showing that the Western method of moving bowels is problematic. The natural position for humans to move bowels is in a squatted position. This position opens up the pathways and results in smooth bowel movements. Western toilets cause humans to move bowels in an unnatural position that results is strained muscles and other issues. There have been many devices that attempt to remedy this problem by providing a more natural squatting position for bowel movements. However, these devices either require expensive new toilet fixtures or take up so much space they are unlikely to be used. These bulky units are a hassle to place and store around the toilet, or have stationary one-size-fits-all pedal heights that do not fit the needs of multiple household members. There has been a long felt need in the art of a simple, portable, storable fecal matter evacuation device.

BRIEF DESCRIPTION OF THE INVENTION

The present invention is a simple, portable, storable fecal matter evacuation device. The device relaxes the puborectalis muscle for easier fecal matter evacuation. The invention has foot rests that can be raised or lowered. In addition, the invention can be placed off to the side out of the way of normal urination practices.

BRIEF DESCRIPTION OF THE DRAWINGS

A better understanding of the present invention may be had from the drawings as described in greater detail in the DETAILED DESCRIPTION OF PREFERRED EMBODIMENT section which follows.

DETAILED DESCRIPTION OF THE INVENTION

The present invention allows the puborectalis muscle to relax for easier fecal matter evacuation. The invention does this by allowing the feet to rest comfortably on the height appropriate steps, taking the pressure off of the puborectalis muscle, relaxing the colon for fecal matter evacuation.

The invention differs from what currently exists. Current units are bulky, more permanent items that become obstacles during normal urination use, and allow the opportunity for additional hygiene issues due to spraying. This invention is a light weight, portable unit that can collapse and be hidden away from view. While current units are not height adjustable for persons that may be smaller or taller than the average user, the foot pedals on the Claimed Invention can be adjusted to the user's optimum height for ease of evacuation.

Figure 1:
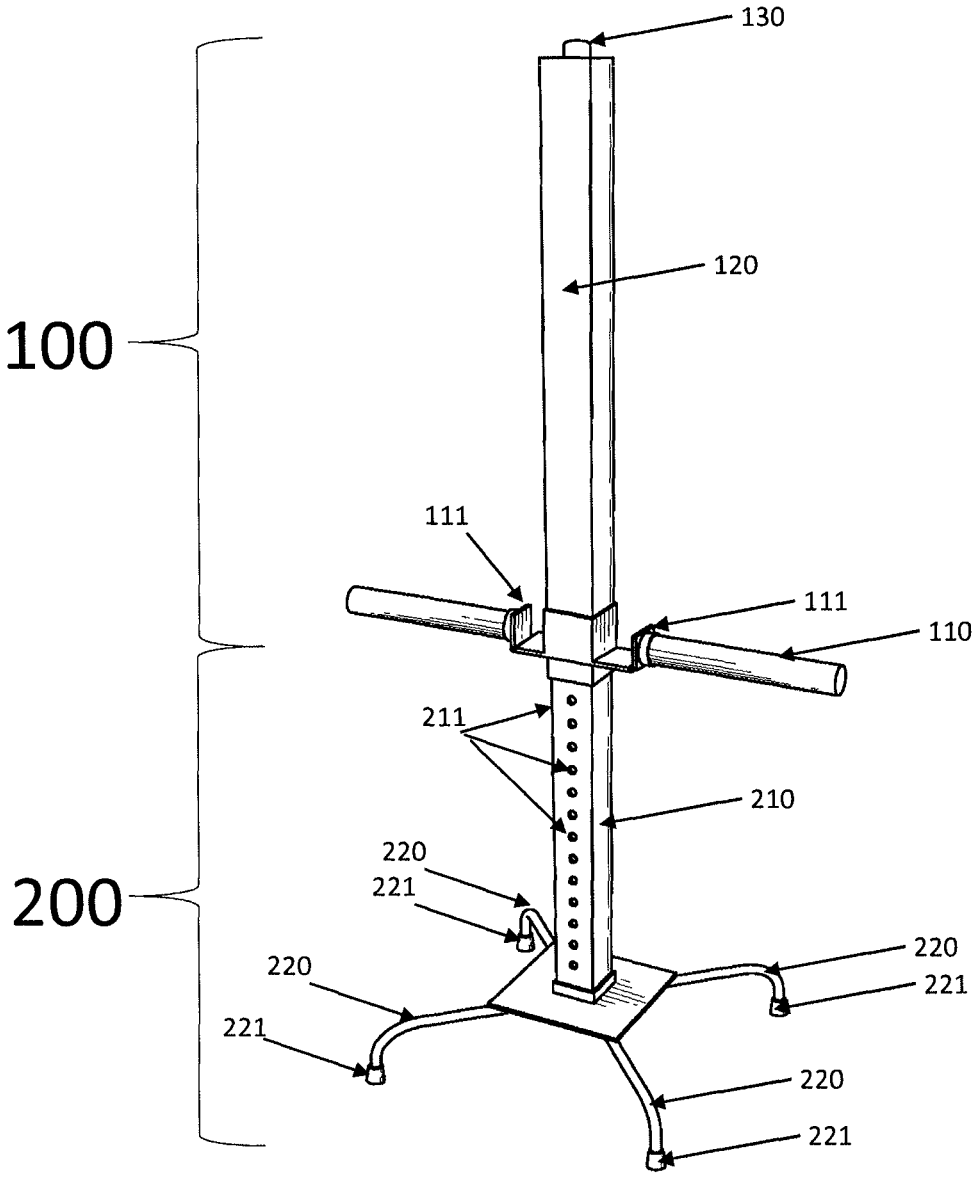
FIG. 1 Isometric projection view of the preferred embodiment of the invention.
Figure 2:
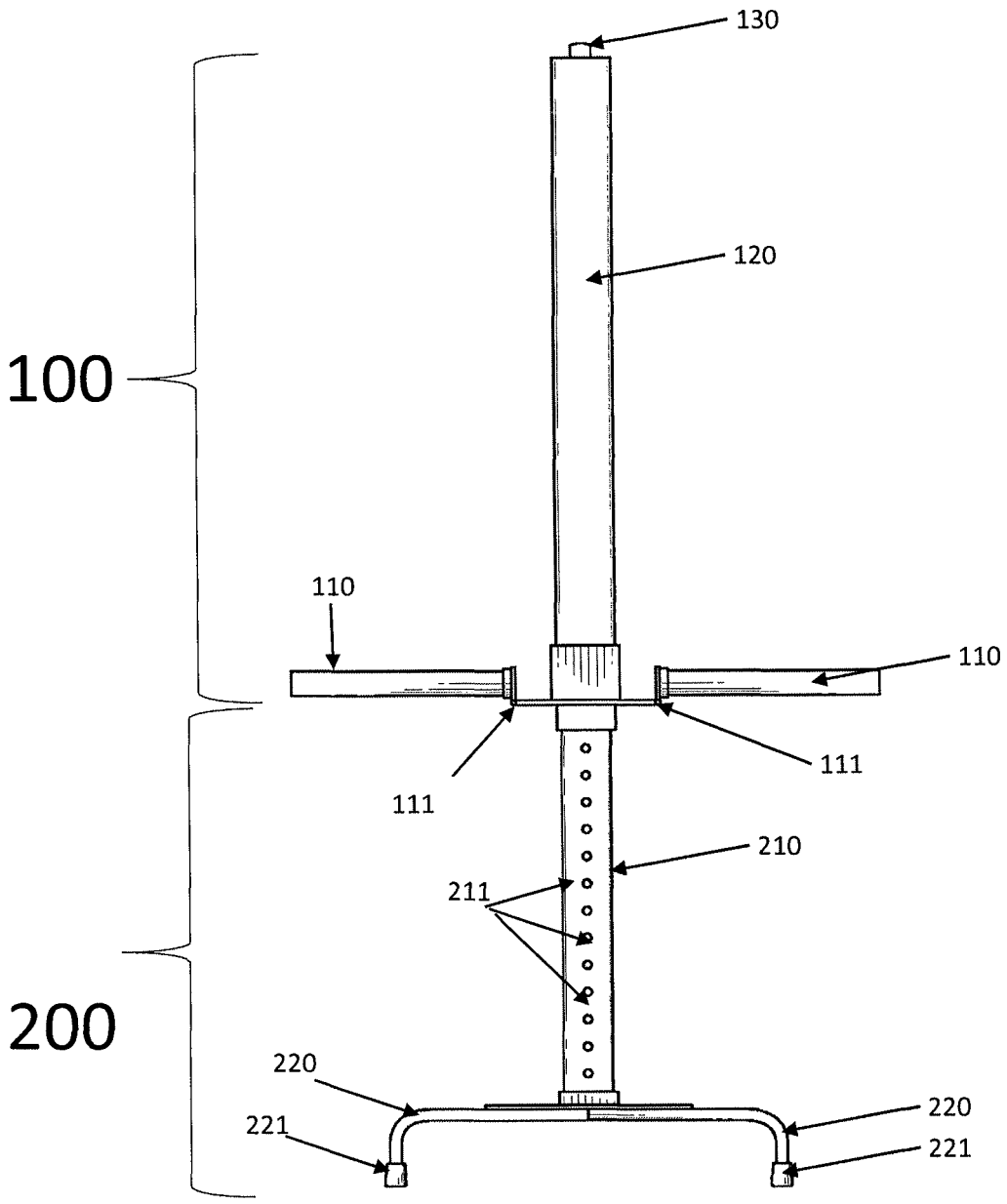
FIG. 2 front facing view of the preferred embodiment of the invention.
Figure 3:
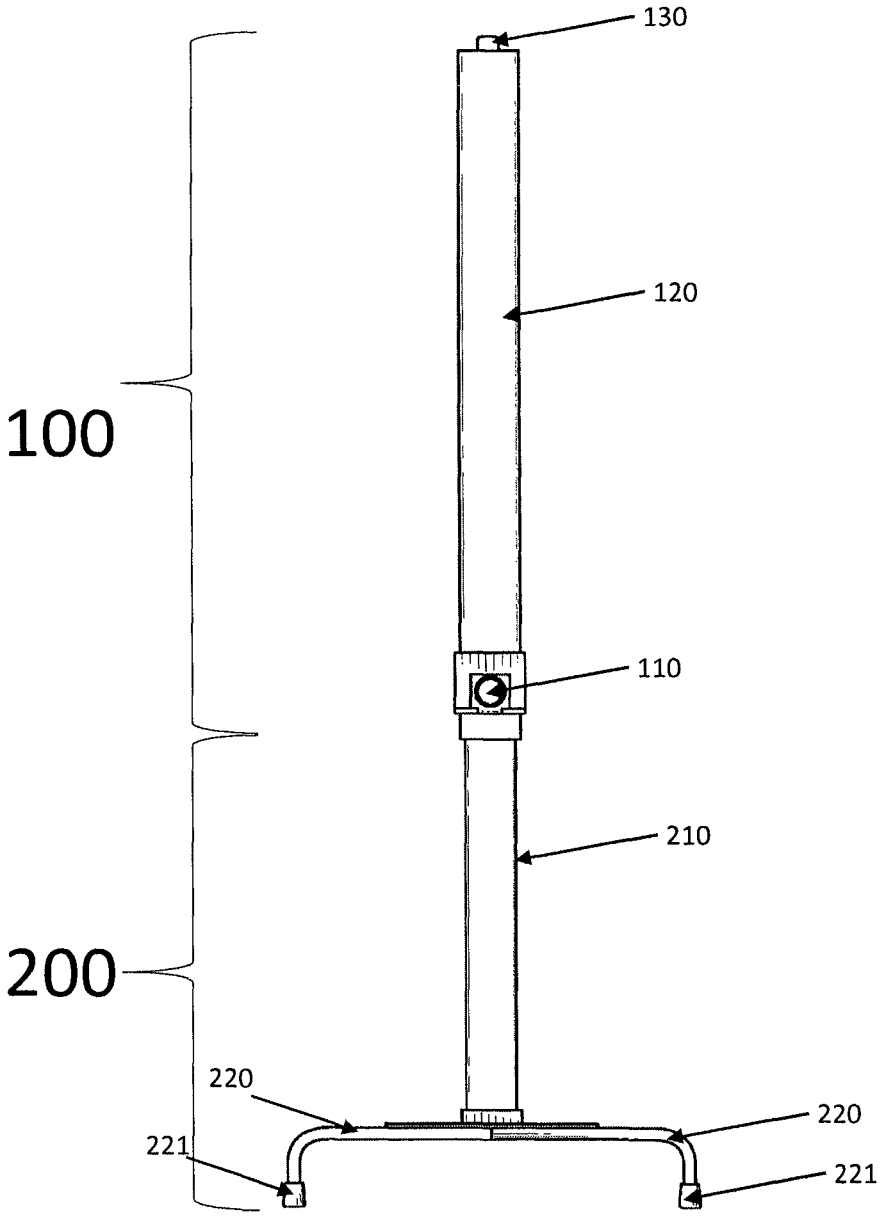
FIG. 3 side perspective view of the preferred embodiment of the invention.
Figure 4:
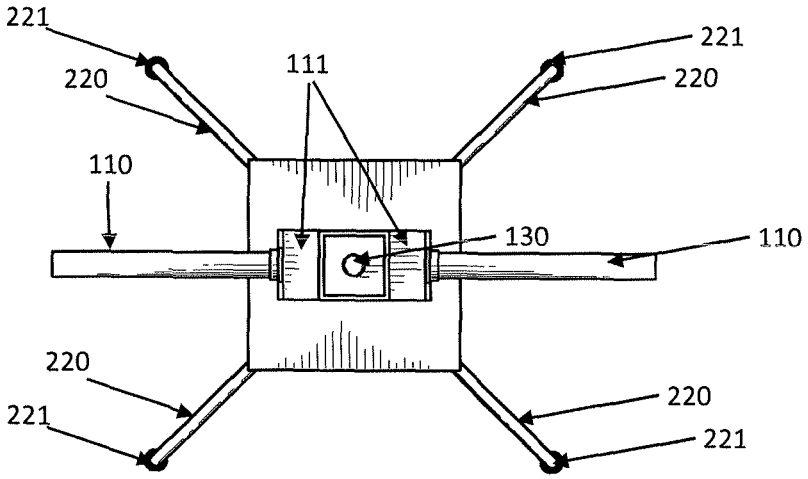
FIG. 4 top down view of the preferred embodiment of the invention.
Figure 5:
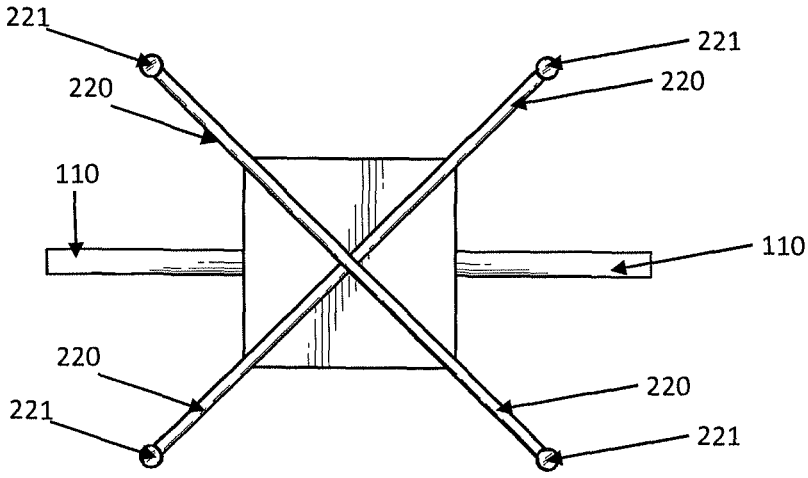
FIG. 5 bottom up view of the preferred embodiment of the invention.

As seen in FIGS. 1-5, the preferred embodiment of the present invention includes a Foot Rest Assembly 100 and a Foot Pedal Assembly 200. The Foot Rest Assembly 100 is composed of the Vertical Outer Pole 110, Nonslip Rubber Foot Rest 120, and the Unlocking Button 130. The Foot Pedal Assembly 200 is composed of the Vertical Inner Pole 210 and the Foot Pedals 220.

The Vertical Outer Pole 110 is designed so that it will fit over the Vertical Inner Pole 210. For example, in the preferred embodiment a prefabricated ½ square, or round, pole is cut to 24 inches as the Vertical Outer Pole 110. In this example, the Vertical Inner Pole 210 is an additional pole with a diameter slightly smaller than ½ inches, so as to fit inside the Vertical Outer Pole 110, which should be cut to 24 inches as well. The Vertical Inner Pole 210 has Locking Holes 211 drilled through each side at ½ inch intervals. The heights for the Locking Holes 211 are marked and annotated on the device and can be adjusted to various intervals based on aesthetic or other preferences. The type of pipe (square or round) is to be made out of any industrial material designed to support substantial weight and can be adjusted depending on aesthetic preferences.

In the preferred embodiment, the device can telescope from 24 inches to 48 inches. The height of the Nonslip Rubber Foot Rest 120 can be adjusted every ½ inch with either hole and pin connectors, rods, slides, or other devises to lock the rung to the ideal height. In some embodiments, the Nonslip Rubber Foot Rest 120 includes Spring Hinges 111 so that the foot rest can further fold up against the Vertical Outer Pole 110 for storage. The Unlocking Button 130 used to unlock the foot rests so they can be folded for easy storage and to unlock and lock the Vertical Outer Pole 110.

The Vertical Inner Pole 210 is attached to the Foot Pedal Assembly 200. In some embodiments, the Vertical Inner Pole 210 can be attached and detached from the Foot Pedal Assembly 200 by screws or other methods for shipping and packing considerations. The Foot Pedal Assembly 200 includes the Foot Pedals 220. In the preferred embodiment, there are four Foot Pedals 220. Each Foot Pedal 220 includes a Nonslip Rubber Foot Pad 221 to be placed at the bottom of each Foot Pedal 220. The Nonslip Rubber Foot Pads 221 are rubberized foot pads to prevent the device from sliding while in use.

In general use, the device is placed in front of the user with the telescoping height extended to adjust to ideal height for the user. The user places feet on the Nonslip Rubber Foot Rest 120 and performs the act of evacuation. When the task is complete, the device can collapse back to storage height and be placed to the side of toilet or in another storage area.

In alternative embodiments, Nonslip Rubber Foot Rest 120 or Nonslip Rubber Foot Pads 221 do not need to be made out of rubber but can be made out of another nonslip product. In other embodiments Nonslip Rubber Foot Pads 221 may be eliminated. In others, the Nonslip Rubber Foot Rest 120 may be stationary and nonadjustable or the pole height can be fixed and nonadjustable, and instead, the height can be adjusted by the two poles interlocking with each other and having the foot rests stationary.

While the principles of the disclosure have been described above in connection with specific methods, it is to be clearly understood that this description is made only by way of example and not as limitation on the scope of the disclosure. Whether now known or later discovered, there are countless other alternatives, variations and modifications of the many features of the various described and illustrated embodiments, both in the process and in the device characteristics, that will be evident to those of skill in the art after careful and discerning review of the foregoing descriptions, particularly if they are also able to review all of the various systems and methods that have been tried in the public domain or otherwise described in the prior art. All such alternatives, variations and modifications are contemplated to fall within the scope of the present invention.

Although the present invention has been described in terms of the foregoing preferred and alternative embodiments, these descriptions and embodiments have been provided by way of explanation of examples only, in order to facilitate understanding of the present invention. As such, the descriptions and embodiments are not to be construed as limiting the present invention, the scope of which is limited only by the claims of this and any related patent applications and any amendments thereto. With reference again to the figures, it should be understood that the graphical representation of the system is an exemplary reference to any number of devices that may be implemented by the present invention.

What is claimed is:

1. A foldable, storable, and portable device for aiding fecal matter evacuation while using conventional toilet fixtures, the device comprising:

a) a foldable foot rest assembly comprising a horizontal non-slip foot rest attached to an outer vertical column;
   i) the horizontal non-slip foot rest for supporting a user's feet while in a squatting position;
   ii) further wherein the non-slip foot rest folds against the vertical support when activated by a locking and unlocking button;

b) a foot pedal assembly with non-slip foot pedals attached to an inner vertical column;

c) the inner vertical column connected to the outer vertical column such that the height of the device can be adjusted between 24 inches and 48 inches at annotated 0.5 inch intervals;

d) the height being locked and unlocked into position for use by a locking and unlocking button located on top of the foot rest assembly allowing for easy access and convenient storage by the user;

e) wherein said device can be folded and stored next to conventional toilet fixtures when not in use.

2. The device as set forth in claim 1, further comprising a hinge attached to the non-slip foot rest that allows the non-slip foot rest to manually fold against the vertical support when activated by the locking and unlocking button.

3. The device as set forth in claim 1, further comprising a spring hinge attached to the non-slip foot rest that allows the non-slip foot rest to automatically fold against the vertical support when activated by the locking and unlocking button.

* * * * *